US008476995B2

(12) United States Patent
Shin

(10) Patent No.: US 8,476,995 B2
(45) Date of Patent: Jul. 2, 2013

(54) RF MEMS SWITCH DEVICE AND MANUFACTURING METHOD THEREOF

(75) Inventor: Kwang-Jae Shin, Yongin (KR)

(73) Assignee: MEMS Solution Inc., Gyeonggi-Do (KR)

( * ) Notice: Subject to any disclaimer, the term of this patent is extended or adjusted under 35 U.S.C. 154(b) by 12 days.

(21) Appl. No.: 13/089,819

(22) Filed: Apr. 19, 2011

(65) Prior Publication Data

US 2012/0255841 A1 Oct. 11, 2012

(30) Foreign Application Priority Data

Apr. 8, 2011 (KR) ..... 10-2011-0032888

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS

| | | | | |
|---|---|---|---|---|
| 6,426,687 | B1 * | 7/2002 | Osborn | 333/262 |
| 7,960,662 | B2 * | 6/2011 | Ziaei | 200/181 |
| 2003/0227361 | A1 * | 12/2003 | Dickens et al. | 335/78 |
| 2009/0272635 | A1 * | 11/2009 | Suzuki | 200/181 |
| 2011/0063774 | A1 * | 3/2011 | Ikehashi et al. | 361/281 |
| 2012/0193685 | A1 * | 8/2012 | Goldsmith et al. | 257/254 |

* cited by examiner

*Primary Examiner* — Bernard Rojas
(74) *Attorney, Agent, or Firm* — Finnegan Henderson Farabow Garrett & Dunner LLP

(57) ABSTRACT

The present invention relates to an RF MEMS switch device comprising: a substrate; a bias electrode positioned on the substrate and supplying bias voltage; a pair of signal electrodes positioned to be spaced-apart each other on the substrate and transmitting an RF signal from one side to the other side; a dielectric layer formed on upper part of the pair of signal electrodes to be overlapped with the pair of signal electrodes; a membrane electrode formed on the dielectric layer to be overlapped with the pair of signal electrodes and the dielectric layer; a bias line connecting between the membrane electrode and the bias electrode; at least one pooling electrode formed to be overlapped with the membrane electrode and having the dielectric layer be interposed therebetween; and a pooling line connecting any one of the pair of signal electrodes and the pooling electrode, and manufacturing method thereof.

5 Claims, 20 Drawing Sheets

RF MEMS SWITCH DEVICE AND MANUFACTURING METHOD THEREOF

CROSS-REFERENCE TO RELATED APPLICATION

This application claims the benefit of priority to Korean Application No. 10-2011-0032888, filed Apr. 8, 2011, the contents of which are incorporated herein by reference.

BACKGROUND

1. Technical Field

The present invention relates to an RF (radio frequency) MEMS (microelectromechanical system) switch device and its manufacturing method.

2. Description of the Related Art

MEMS switch device is a technology creating mechanical parts embedded in an electric switch device using semiconductor processing techniques.

When a switch is on, a MEMS switch device shows lower insertion loss than a semiconductor switch and when it is off, a MEMS switch device shows higher attenuation than a semiconductor switch. A MEMS switch device also needs less switch driving power than a semiconductor switch device. However, because an electrostatic attraction is proportional to the inverse of the distance between counter electrodes, the farther distance between counter electrodes becomes, the smaller electrostatic attraction does. Thus, a MEMS switch device requires more driving voltage with increased distance between counter electrodes. Here, an intersected area between a membrane electrode and a signal electrode, which generates electrostatic attraction, can be larger or a distance between a membrane electrode and a signal electrode becomes closer to reduce driving voltage. In this case, when a switch is off, electrical insulating characteristics can be lowered.

In addition, when charges are accumulated on a dielectric material between a membrane electrode and a signal electrode, stiction, which is adhesion phenomenon between a membrane electrode and a signal electrode, can be caused. Such a stiction phenomenon is intensified in proportion to driving voltage amplitude and an intersected area between a membrane electrode and a signal electrode.

Therefore, there is demand for MEMS switch devices operating at a low driving voltage and having small intersected area while maintaining a constant distance between a membrane electrode and a signal electrode.

SUMMARY

An object of the present invention is to provide an RF MEMS switch device with improved on/off characteristics and its manufacturing method.

According to an aspect of the present invention, there is provided an RF MEMS switch device comprising: a substrate; a bias electrode positioned on the substrate and supplying bias voltage; a pair of signal electrodes positioned to be spaced-apart each other on the substrate and transmitting an RF signal from one side to the other side; a dielectric layer formed on upper part of the pair of signal electrodes to be overlapped with the pair of signal electrodes; a membrane electrode formed on the dielectric layer to be overlapped with the pair of signal electrodes and the dielectric layer; a bias line connecting between the membrane electrode and the bias electrode; at least one pooling electrode formed to be overlapped with the membrane electrode and having the dielectric layer be interposed therebetween; and a pooling line connecting any one of the pair of signal electrodes and the pooling electrode.

The pooling electrode is formed to be insulated from the signal electrode on the same plane with the signal electrode.

The bias line or the pooling line may be formed of a high resistance conductive material comprising any one of SiCr, Ti, and TiW or a conductive material comprising any one of doped Si and SiC.

The membrane electrode contacts with the dielectric layer to transmit an RF signal applied to one side of the signal electrodes to the other side of the signal electrodes, when the bias voltage is supplied.

An RF MEMS switch device according to an embodiment of the present invention may further comprise at least one connecting electrode connected to the membrane electrode, wherein the connecting electrode may be electrically connected with the bias line.

According to another aspect of the present invention, there is provided an RF MEMS switch device comprising: a substrate; a bias electrode positioned on the substrate and supplying bias voltage; a signal electrode positioned on the substrate and transmitting an RF signal applied to one side end to the other side end; a dielectric layer formed on upper part of the signal electrodes to be overlapped with the pair of signal electrodes; a membrane electrode formed on upper part of the dielectric layer to be overlapped with the signal electrodes and the dielectric layer; a ground electrode connected to at least one of both ends of the membrane electrode; a bias line connecting between the membrane electrode and the bias electrode; at least one pooling electrode formed to be overlapped with the membrane electrode and having the dielectric layer be interposed therebetween; and a pooling line connecting any one of both ends of signal electrodes with the pooling electrode.

The membrane electrode may contact with the dielectric layer to bypass an RF signal applied to one end of the signal electrodes to the ground electrode when the bias voltage is supplied, and return to be spaced-apart from the dielectric layer when the bias voltage is removed.

The pooling electrode may be formed to be insulated from the signal electrode on the same plane with the signal electrode.

The bias line or the pooling line may be formed of a high resistance conductive material comprising any one of SiCr, Ti, and TiW or a conductive material comprising any one of doped Si and SiC.

According to another embodiment of the present invention, there is provided a method for manufacturing an RF MEMS switch device comprising: (a) forming any one of a bias line, a pooling line and a pooling electrode; (b) forming any one electrode of a bias electrode connected with one end of the bias line, a connecting electrode connected with the other end of the bias line, and signal electrodes spaced-apart each other and one of which is connected to the pooling line; (c) forming a dielectric layer overlapping with the signal electrodes; and (d) forming a membrane electrode to be connected with the connecting electrode and overlapped with the pooling electrode, the signal electrode and the dielectric layer.

The step (a) may be patterning a high resistance conductive material comprising any one of SiCr, Ti, and TiW or a conductive material comprising any one of doped Si and SiC.

In the step (b), the electrode may be formed of any one of Au, Al, Cu, Mo, W, Pt, Ru, and Ni, or an alloy comprising any one of Au, Al, Cu, Mo, W, Pt, Ru, and Ni.

The step (d) may comprise: forming a sacrificial layer on the upper surface of the dielectric layer; forming contact holes to expose the upper surface of the connecting electrode by removing the area of the connecting electrode and the sacrificial layer where overlapping with the connecting electrode; forming a membrane electrode connected with the connecting electrode through the contact holes and positioned on the sacrificial layer; and removing the sacrificial layer.

The membrane electrode is formed of any one of Au, Al, Cu, Mo, W, Pt, Ru, and Ni, or an alloy comprising any one of Au, Al, Cu, Mo, W, Pt, Ru, and Ni.

The method may further comprise forming a buffer layer to cover the substrate before the step (a).

According to embodiments of the present invention, switch on/off characteristics can be improved by forming a pooling electrode overlapping with a membrane electrode.

BRIEF DESCRIPTION OF THE DRAWINGS

FIG. 20 to FIG. 17 are views illustrating a method for manufacturing a MEMS switch according to an embodiment of the present invention.

FIG. 20 is a circuit diagram illustrating an equivalent circuit of the MEMS switch of FIG. 18.

DETAILED DESCRIPTION

While the present invention has been described with reference to particular embodiments, it is to be appreciated that various changes and modifications may be made by those skilled in the art without departing from the spirit and scope of the present invention, as defined by the appended claims and their equivalents.

Throughout the description of the present invention, when describing a certain technology is determined to evade the point of the present invention, the pertinent detailed description will be omitted. In addition, while such terms as "first" and "second," etc., may be used to describe various components, such components must not be limited to the above terms. The above terms are used only to distinguish one component from another.

Further, in the present description, unless clearly used otherwise, an expression such as "connected" or "connecting" is intended to include connection of one component directly to another one and connection of one component to another one by using a further another one inbetween. Also, unless clearly used otherwise, expressions in the singular number include a plural meaning.

Hereinafter, preferred embodiments will be described in detail of an RF MEMS switch device and its manufacturing method according to the present invention.

Figure 1:
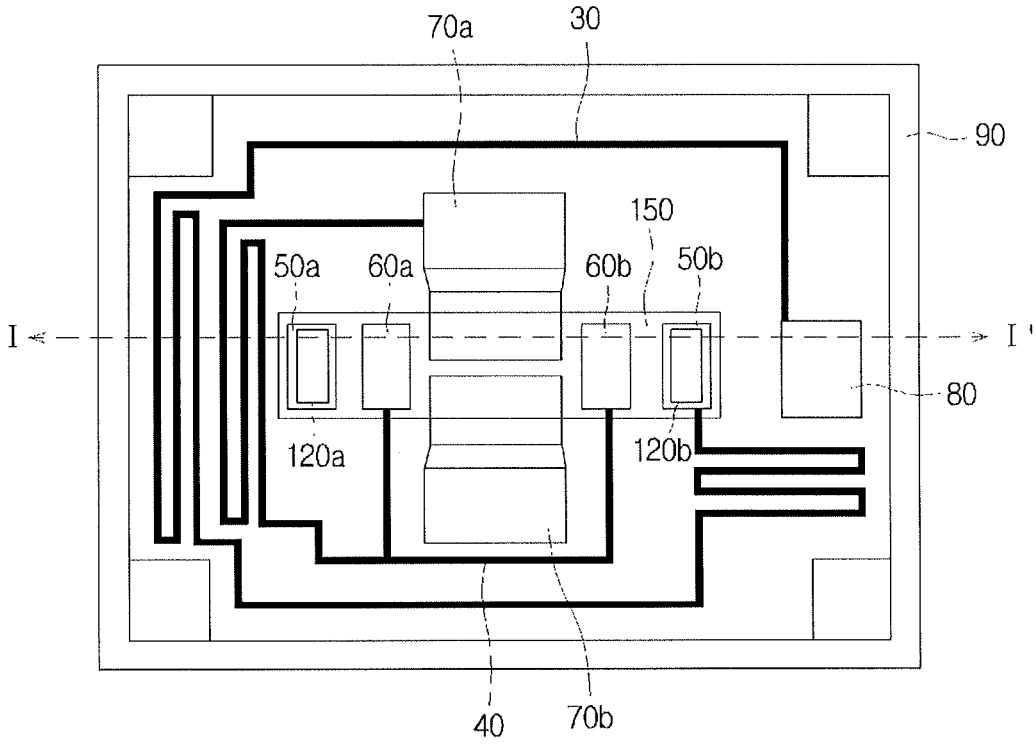
FIG. 1 is a plan view illustrating a MEMS switch device according to a first embodiment of the present invention.
Figure 2:
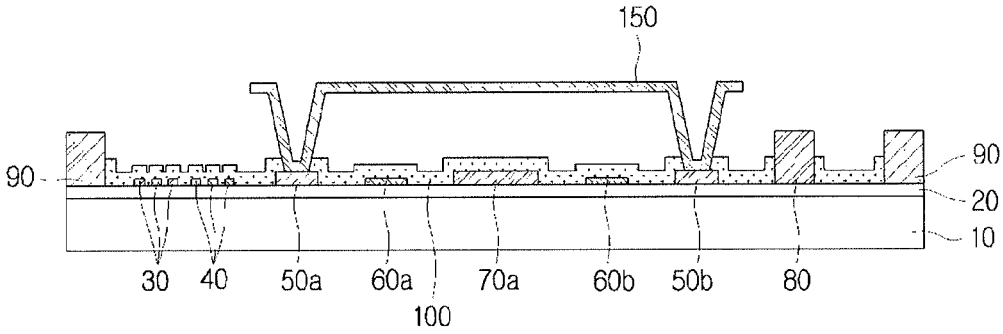
FIG. 2 is a sectional view illustrating the section cut along with I-I' line of the MEMS switch of FIG. 1.

FIG. 1 is a plan view illustrating a MEMS switch device according to a first embodiment of the present invention and FIG. 2 is a sectional view illustrating the section cut along with I-I' line of the MEMS switch of FIG. 1. Here, FIG. 1 represents an embodiment of the continuum structure of a MEMS switch.

Referring to FIG. 1 and FIG. 2, a MEMS switch device according to a first embodiment of the present invention may comprise a substrate 10, a buffer layer 20, a bias electrode 80, signal electrodes 70*a*, 70*b*, a dielectric layer 100, a membrane electrode 150, a bias line 30, pooling electrodes 60*a*, 60*b*, a pooling line 40 and an edge ground 90.

Particularly, the substrate 10 may be formed of a material suitable for semiconductor processing such as high resistance silicon wafer, glass or GaAs, etc. to keep RF characteristics.

The buffer layer 20 improves interfacial characterization with the bias electrode 80, the signal electrode 70*a*, 70*b*, the bias line 30, the pooling electrode 60*a*, 60*b* or the pooling line 40. The buffer layer 20 is formed on the substrate 10 by chemical vapor deposition. The buffer layer 20 may be formed of, for example, SiNx, SiOx or SiOxNx, etc.

The bias electrode 80 is an electrode to supply DC bias voltage and fowled on one side of the substrate 10. The bias electrode 80 may be exposed to outside to be supplied with bias voltage. The bias electrode 80 may be formed of a metal material having high melting point and low resistance. The bias electrode 80 may be a metal pad formed of at least one of or an alloy including any one of Au, Cu, Al, Mo, W, Pt, Ru, Ni and the like.

The signal electrode 70*a*, 70*b* is formed as a pair and transmits an RF signal applied to one side to the other side. Here, the signal electrode 70*a*, 70*b* may be spaced-apart with a predetermined interval which is enough not to cause RF signal coupling. The signal electrode 70*a*, 70*b* may be formed to be overlapped with a predetermined region of the membrane electrode 150 by interposing the dielectric layer 100 therebetween. The signal electrode 70*a*, 70*b* may couple with the membrane electrode 150 at the region where overlapping with the membrane electrode 150 to couple an RF signal from one side of the signal electrode 70*a* to the other side 70*b*, when bias voltage is supplied. The signal electrode 70*a*, 70*b* may be formed with a metal material with high melting point and low resistance. The signal electrode 70*a*, 70*b* may be a metal pad formed with at least one metal material of Au, Cu, Al, Mo, W, Pt, Ru, Ni and the like or an alloy including any one of Au, Cu, Al, Mo, W, Pt, Ru, Ni and the like.

The membrane electrode 150 modifies to contact with the dielectric layer 100 when bias voltage is supplied. As shown in FIG. 2, the membrane electrode 150 positions not to contact with the upper part of the dielectric layer 100 when bias voltage is not supplied and moves to a lower direction to contact with the dielectric layer 100 when bias voltage is supplied.

The membrane electrode 150 is formed with a material having elasticity to allow moving up and down and restoring force when bias voltage is removed. For example, the membrane electrode 150 may be formed with any one of Au, Al, Cu, Mo, W, Pt, Ru, and Ni or be a metal material including any one of Au, Al, Cu, Mo, W, Pt, Ru, and Ni.

The dielectric layer 100 may be formed on the upper part of the signal electrode 70*a*, 70*b*, the bias line 30, the pooling electrode 60*a*, 60*b* and the pooling line 40. The dielectric layer 100 may be formed of a high dielectric material. For example, the dielectric layer 100 may be SiO2, SiNx, ZrO2, TiO2, TaO2, BST, PZT or the like.

The dielectric layer 100 may be formed to cover not only the signal electrode 70*a*, 70*b* but also the upper part of the pooling electrode 60*a*, 60*b*.

The bias line 30 is electrically connected with one side of the membrane electrode 150. The bias line 30 may be formed of a high resistance conductive material to prevent backflow of an RF signal to the bias electrode 80.

For example, the bias line 30 may be formed of any one material chosen from SiCr, Ti, TiW, doped Si, SiC and the like. Here, connecting electrodes 50*a*, 50*b* may be further formed to connect between the bias line 30 and the membrane electrode 150.

The connecting electrode 50*a*, 50*b* may be formed at the same plane with the signal electrode 70*a*, 70*b* or the pooling electrode 60*a*, 60*b*. The connecting electrode 50*a*, 50*b* may be formed with a metal material having high melting point and low resistance. The connecting electrode 50*a*, 50*b* is connected with the bias line 30 and connected to the membrane electrode 150 through contact holes 120*a*, 120*b* to supply bias voltage to the membrane electrode 150.

The pooling electrode 60*a*, 60*b* may be formed to be insulated from the signal electrode 70*a*, 70*b* at the same plane with the signal electrode 70*a*, 70*b*. The pooling electrode 60*a*, 60*b* may be formed to overlap with the membrane electrode 150 by having a dielectric material therebetween to have a predetermined area so that a pooling area and capacitance value of a MEMS switch device are increased. Here, the dielectric material may be a dielectric layer 100 or air. The pooling electrode 60*a*, 60*b* may be formed of a metal material having high melting point and low resistance. For example, the pooling electrode 60*a*, 60*b* may be a metal pad formed with at least one of or an alloy including any one of Au, Cu, Al, Mo, W, Pt, Ru, Ni and the like.

The pooling line 40 is formed to connect one side of the signal electrodes 70*a*, 70*b* with the pooling electrode 60*a*, 60*b*. The pooling line 40 may be formed of a high resistance metal material to prevent backflow of a RF signal applied to the signal electrode 70*a*, 70*b* to the pooling electrode 60*a*, 60*b*. For example, the pooling line 40 may be formed of any one material chosen from SiCr, Ti, and TiW.

The edge ground electrode 90 may be formed along the edge of the substrate 10 on the buffer layer 20.

Figure 3:
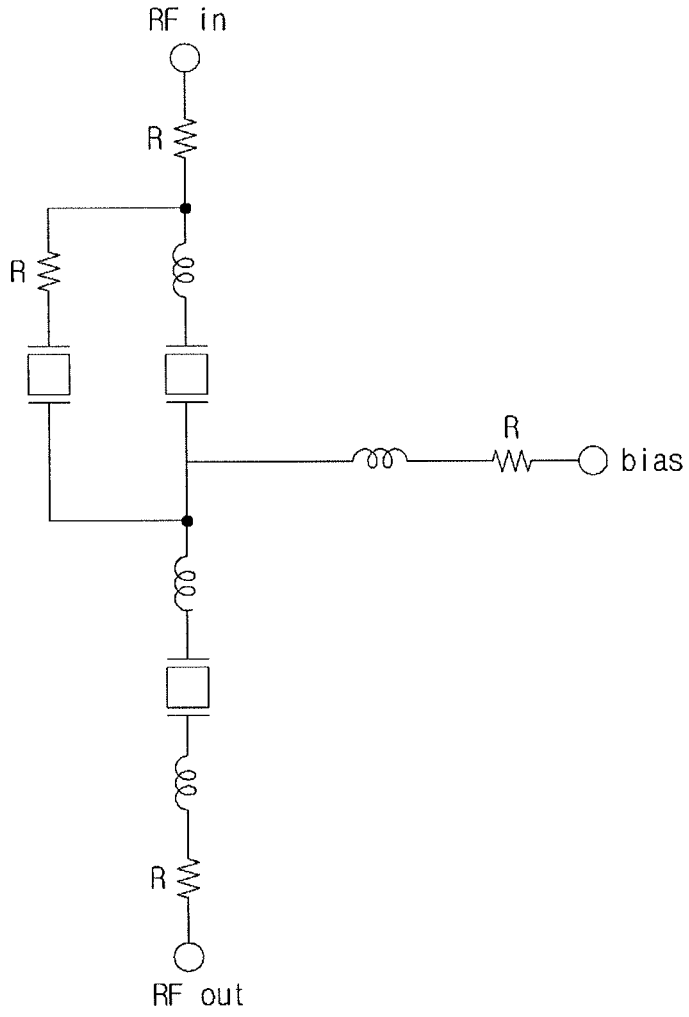
FIG. 3 is a circuit diagram illustrating an equivalent circuit of the MEMS switch of FIG. 1.

FIG. 3 is a circuit diagram illustrating an equivalent circuit of the MEMS switch of FIG. 1. Here, components of the MEMS switch illustrated in FIG. 1 will be described by quoting with reference numbers.

As shown in FIG. 3, a MEMS switch according to a first embodiment of the present invention generates electrostatic force when a predetermined dc bias voltage is applied to generate attracting force between the membrane electrode 150 and the signal electrode 70*a*, 70*b* and the pooling electrode 60*a*, 60*b*. Here, the signal electrode 70*a*, 70*b* and the pooling electrode 60*a*, 60*b* are fixed on the substrate so that the membrane electrode 150 having elasticity is bent to the direction of the signal electrode 70*a*, 70*b*. Here, when the membrane electrode 150 contacts with the dielectric layer 100, RF signal applied to one side of the signal electrode 70*a*, 70*b* is transferred to the other side by coupling. The pooling electrode 60*a*, 60*b* increases a pooling area functioning as a capacitor, resulting in increase of electrostatic force by the increased area even though the same driving voltage is applied. Therefore, when low driving voltage is applied, the membrane electrode 150 can be made to be bent.

Here, since the pooling line 40 connected between the pooling electrode 60*a*, 60*b* and the signal electrode 70*a*, 70*b* is made of a high resistance metal material, RF signal coupling can be prevented by a capacitor formed between the pooling electrode and the signal electrode.

Because a MEMS switch device including pooling electrodes 60*a*, 60*b* according to a first embodiment of the present invention has higher capacitance value than that when the pooling electrode 60*a*, 60*b* is not formed, RF signal coupling can be prevented by a capacitor formed by introducing a high resistance pooling line while lowering driving voltage. Therefore, it allows improving on/off characteristics of the RF MEMS switch device.

Further, because the height of the pooling electrode 60*a*, 60*b* is formed to be lower than that of the signal electrode 70*a*, 70*b* in a MEMS switch device according to a first embodiment of the present invention, it can eliminate a stiction problem between the membrane electrode 150 and the signal electrode 70*a*, 70*b*, caused during driving for a long period of time without increasing contact area by the pooling electrode 60*a*, 60*b* when a switch is on.

FIG. 4 to FIG. 17 are views illustrating a method for manufacturing a MEMS switch according to an embodiment of the present invention in order. FIG. 4, FIG. 6, FIG. 8, FIG. 9, FIG. 10, FIG. 12, FIG. 13, FIG. 14, FIG. 16 and FIG. 17 are sectional views illustrating the section cut along with I-I' line of the MEMS switch of FIG. 1 to effectively explain a method for manufacturing an RF MEMS switch device as in FIG. 2.

Referring to FIG. 4 to FIG. 17, a method for manufacturing an RF MEMS switch device according to an embodiment of the present invention may comprise forming a buffer layer, forming a bias line, a pooling line and a pooling electrode, forming signal electrodes and a bias electrode, forming a dielectric layer, forming a sacrificial layer, forming contact holes and exposing electrodes, forming a pad and forming a membrane electrode.

Figure 4:
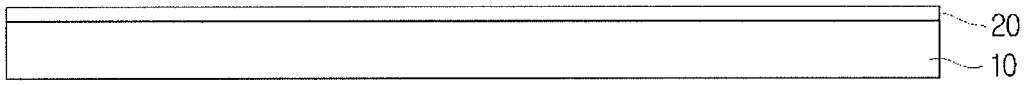
FIG. 4 to FIG. 17 are views illustrating a method for manufacturing a MEMS switch according to an embodiment of the present invention.

In particular, referring to FIG. 4, the step of forming a buffer layer forms a buffer layer 20 on a substrate 10. The buffer layer 20 is formed of an insulating material such as SiO2, SiNx and the like with a thickness of 5000 Å on the substrate 10 such as wafer and the like.

Figure 5:
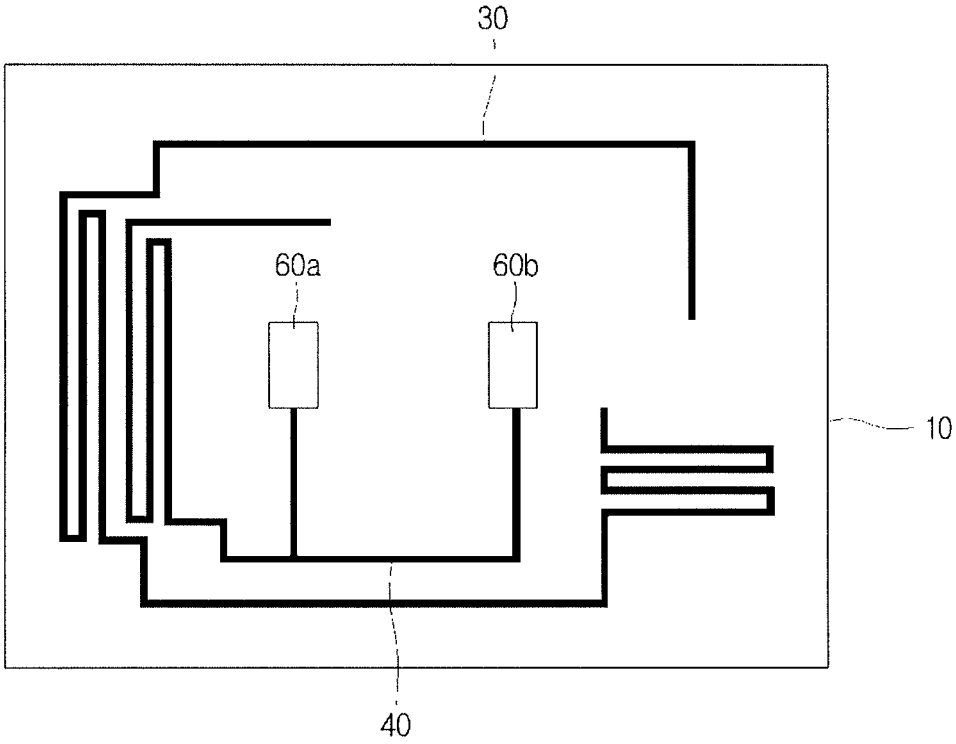
Figure 6:
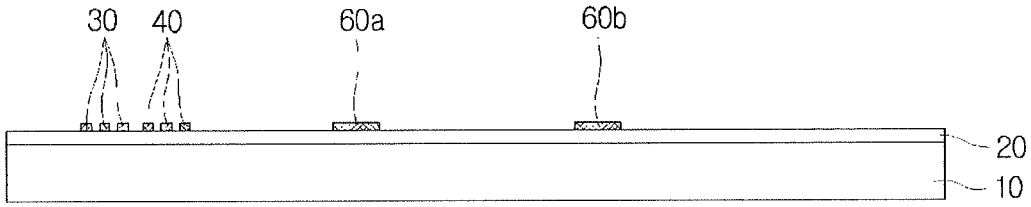

As shown in FIG. 5 and FIG. 6, a bias line 30 is formed on the upper part of the buffer layer 20 in the step of forming a bias line, a pooling line and a pooling electrode. The bias line 30 is formed by forming a metal layer with a material such as SiCr, Ti, TiW and the like or a material such as doped Si, SiC and the like on the upper part of the buffer layer 20 by using a deposition method such as sputtering and the like and then etching the metal layer through a photo lithography process. A pooling line 40 may be formed with the same process. The bias line 30, the pooling line 40, and the pooling electrode 60*a*, 60*b* may be formed by patterning a metal layer in the form of a maximum length of the growing to have high resistance.

Further, the bias line 30, the pooling line 40, and the pooling electrode 60*a*, 60*b* may be formed by using print or screen processing in addition to the photo lithography process.

Figure 7:
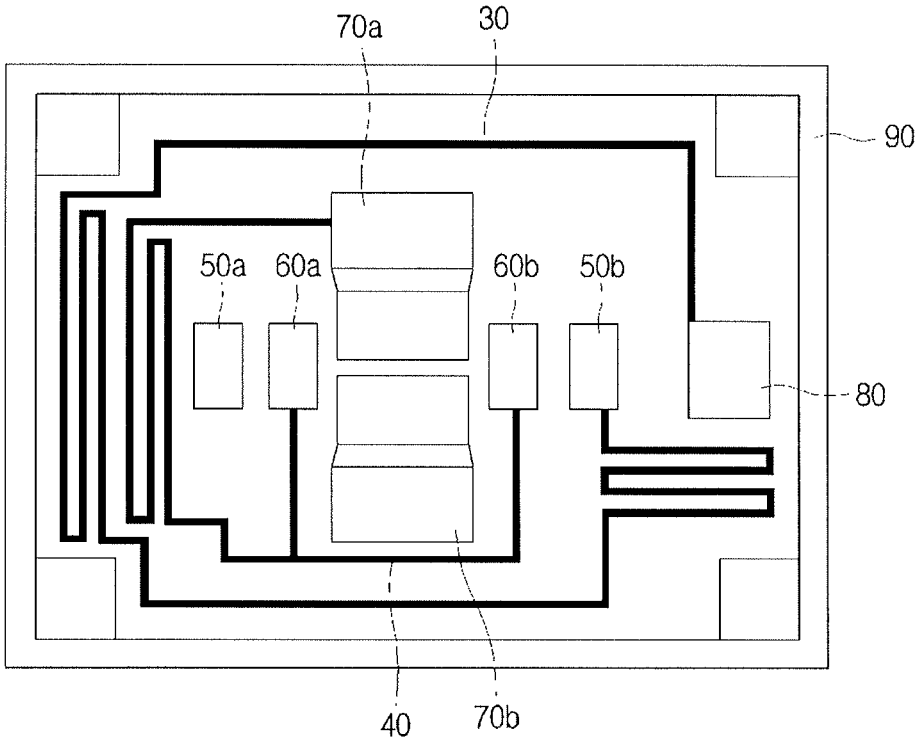
Figure 8:
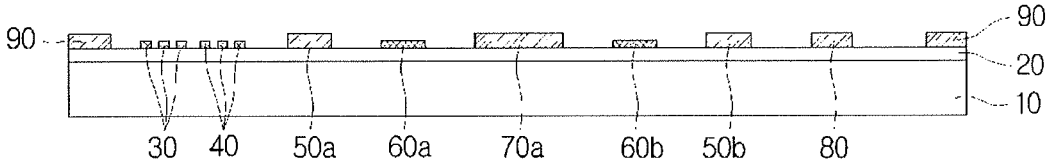

As shown in FIG. 7 and FIG. 8, a bottom electrode layer including signal electrodes 70*a*, 70*b* and a bias electrode 80 is formed in the step of forming signal electrodes and a bias electrode. Here, connecting electrodes 50*a*, 50*b* may be further included in the bottom electrode layer to connect with a membrane electrode. Edge ground electrode in the edge of the substrate may be further included in the bottom electrode layer.

The bottom electrode layer is formed by forming a metal layer on the buffer layer 20 by a deposition method such as sputtering and the like using any one of Au, Al, Cu, Mo, W, Pt, and Ru or an alloy including any one of Au, Al, Cu, Mo, W, Pt, and Ru, and then etching the metal layer through the photo lithography process. Here, one side of the signal electrode 70*a*, 70*b* is formed to be connected with pooling line 40 connected with the pooling electrode 60*a*, 60*b*. Further, one side of the bias electrode 80 is formed to be connected with one side of the connecting electrode 50*a*, 50*b*.

Figure 9:
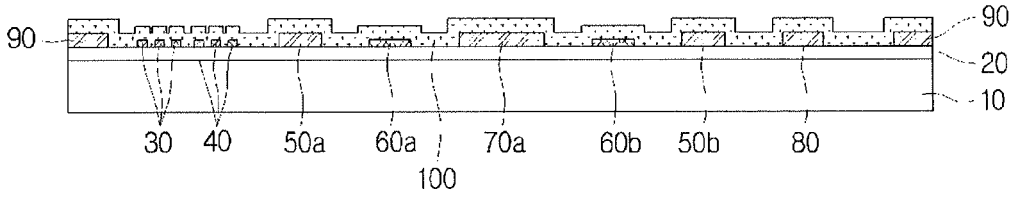

As shown in FIG. 9, a dielectric layer 100 is formed to cover the bias line 30, the pooling line 40, the bias electrode 80, the pooling electrode 60*a*, 60*b*, the signal electrode 70*a*, 70*b* or the edge ground electrode 90 in the step of forming a dielectric layer.

The dielectric layer 100 is formed by using a SiO2, SiNx, ZrO2, TiO2, TaO2, BST, or PZT material having a high dielectric constant through a thin film deposition process such as CVD and sputtering process, etc. with a thickness of 500 Å to about 5000 Å on the substrate 10.

Figure 10:
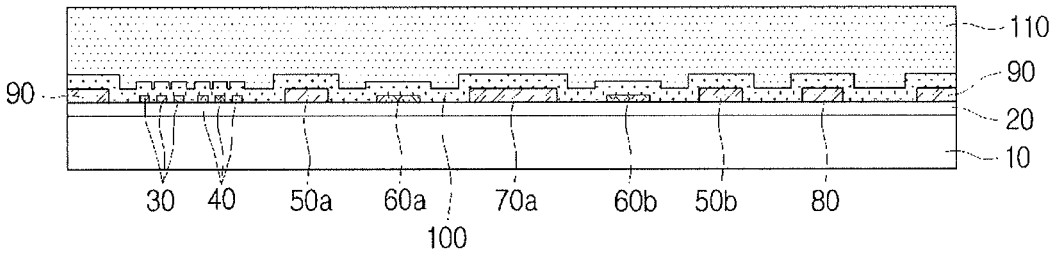

As shown in FIG. 10, a sacrificial layer 110 is formed with a thickness of greater than a few micro meters on the dielectric layer 100 in the step of forming a sacrificial layer. The sacrificial layer 110 is formed with a polyimide, a photoresist polymer, SiO2, or a polysilicon, etc. The sacrificial layer 110 is formed by using a spin coating or a thin film deposition method, etc.

Figure 11:
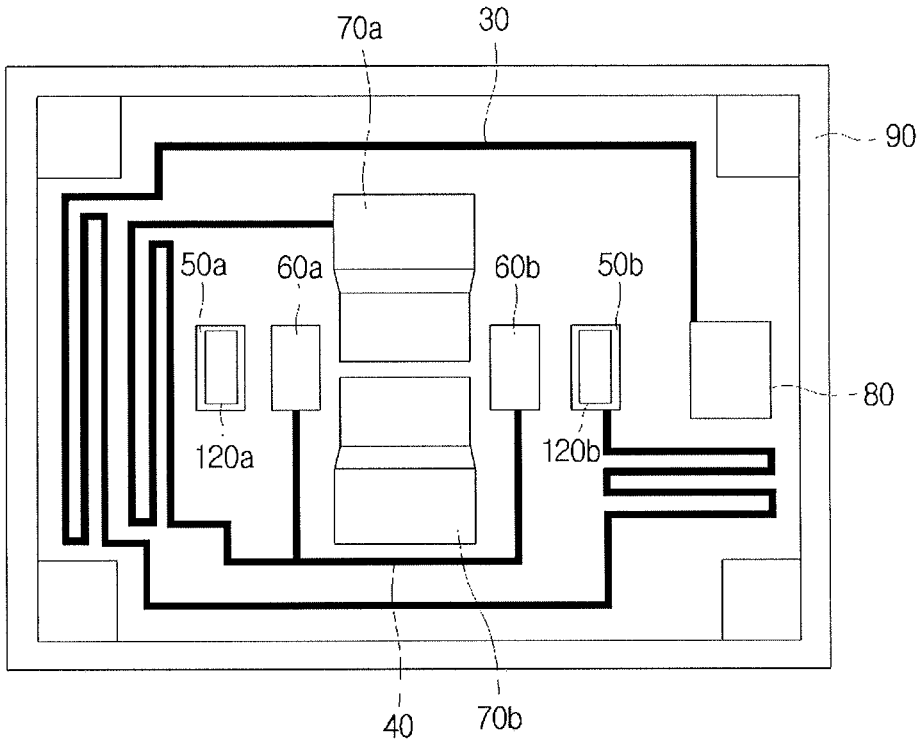
Figure 12:
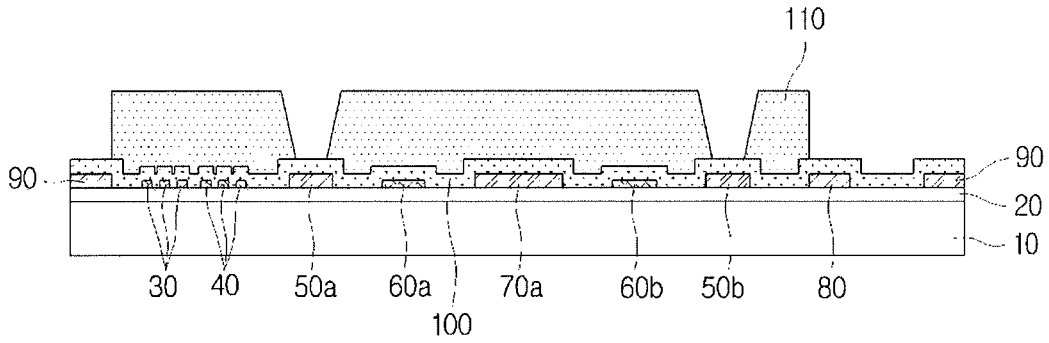
Figure 13:
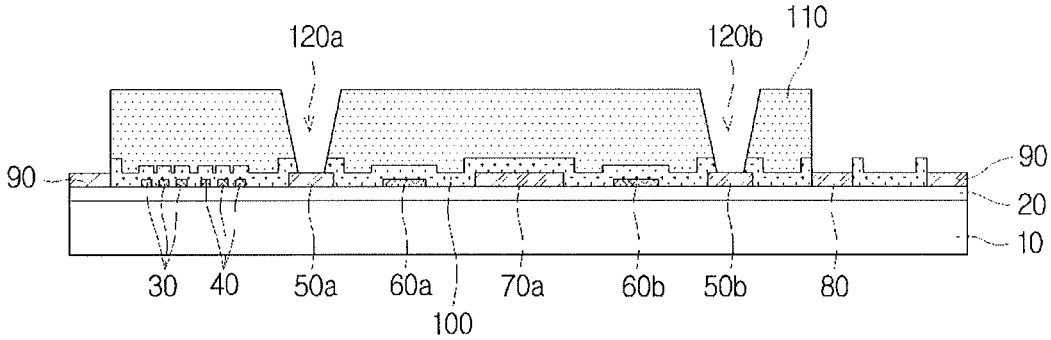

As shown in FIG. 11, FIG. 12 and FIG. 13, the step of forming contact holes and exposing electrodes include etching the sacrificial layer 110 and etching the dielectric layer 100.

The step of etching the sacrificial layer 110 etches the part of the sacrificial layer 110 where overlapping with the connecting electrode 50*a*, 50*b*, the bias electrode 80 or the edge ground electrode 90 by using a mask process using an appropriate photo sensitizer.

The step of etching the dielectric layer 110 etches the dielectric layer 110 exposed by the etched sacrificial layer 110. The etching of the dielectric layer 110 is performed by using a mask process using an appropriate photosensitizer as well as the etching of the sacrificial layer 110. Thus, the contact holes 120*a*, 120*b* exposing the supper part of the connecting electrode 50*a*, 50*b* are formed through the etching of the dielectric layer 110. In addition, the upper part of the bias electrode 80 or the edge ground electrode 90 are exposed through the etching of the dielectric layer 110.

Figure 14:
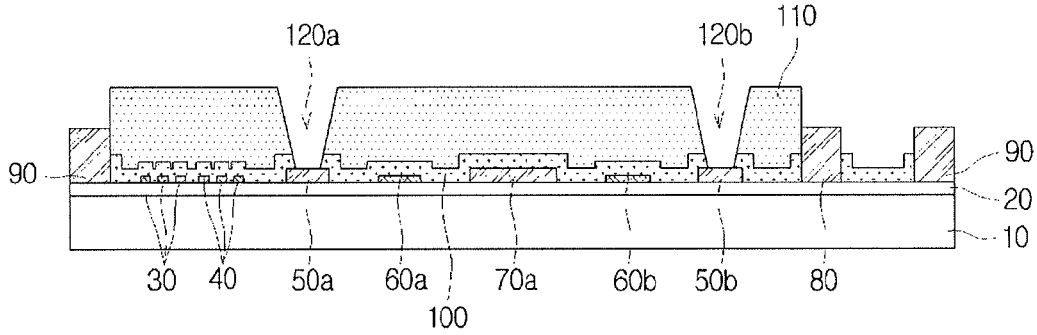

As shown in FIG. 14, a metal layer is formed to connect the exposed bias electrode and the exposed edge ground electrode and each metal pad of the bias electrode and the edge ground electrode is formed by patterning the metal layer through the photo lithography process. Here, each of the bias electrode and the edge ground electrode is formed as a metal pad and exposed to outside enable to be electrically connected with external devices.

Figure 15:
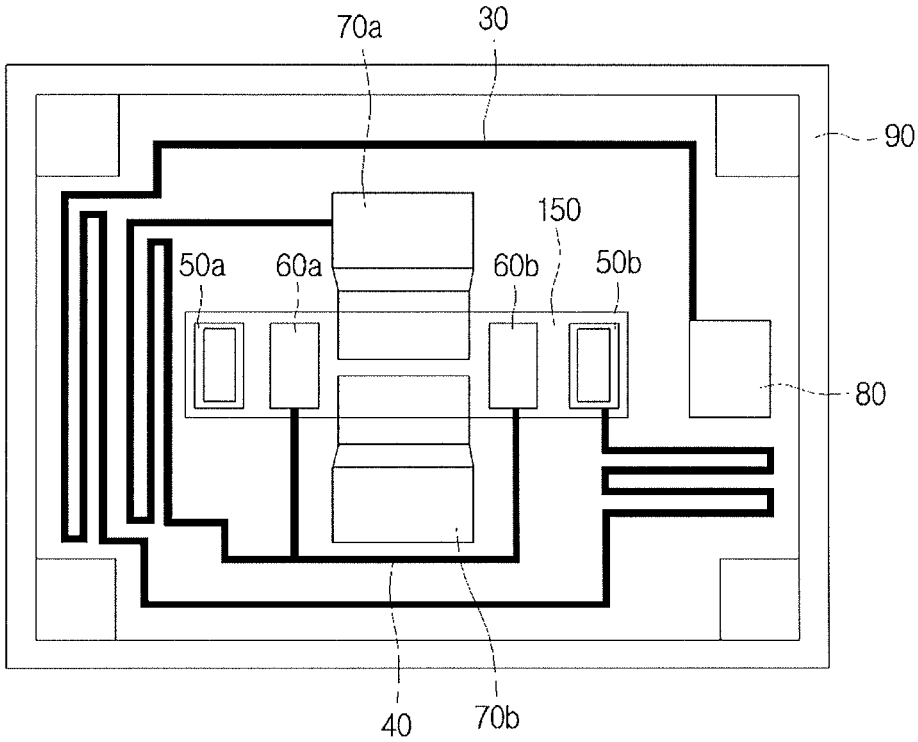
Figure 16:
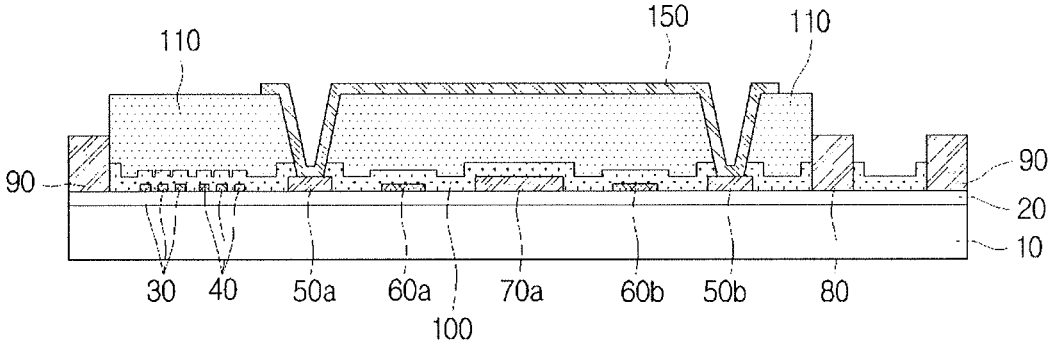
Figure 17:
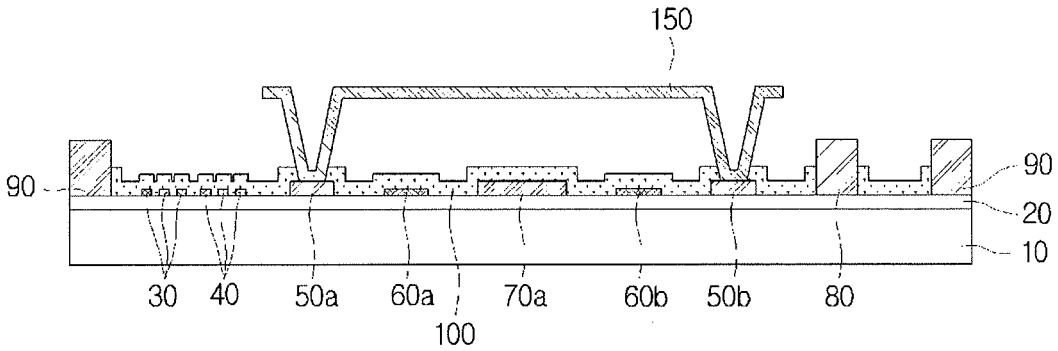

As shown in FIG. 15, FIG. 16 and FIG. 17, a membrane electrode 150 is formed and the sacrificial layer 110 is removed in the step of forming a membrane electrode.

In particular, referring to FIG. 15 and FIG. 16, a metal material which is one chosen from Au, Al, Cu, Mo, W, Pt, Ru, and Ni or includes one chosen from Au, Al, Cu, Mo, W, Pt, Ru, and Ni is deposited on the upper part of the sacrificial layer 110 and the connecting electrode 50*a*, 50*b* exposed to outside by using a sputtering method. And then a membrane electrode 150 is formed to be connected with the connecting electrode 50*a*, 50*b* by a patterning process. Here, the membrane electrode 150 is connected with the connecting electrode 50*a*, 50*b* through the contact holes 120*a*, 120*b*.

As shown in FIG. 17, the sacrificial layer 110 formed on the dielectric layer 100 is removed. Thus, the dielectric layer 100 is exposed since the sacrificial layer 110 is removed.

Here, etching of the sacrificial layer 110 may be performed by a reactive ion etching or a wet etching process.

Figure 18:
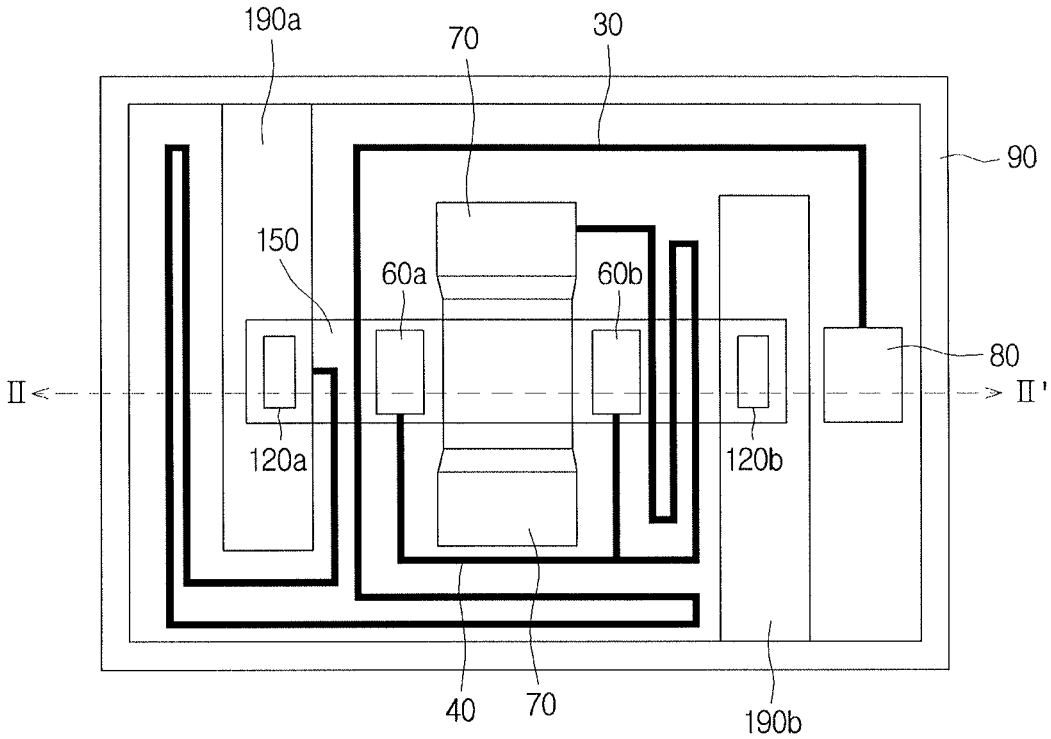
FIG. 18 is a plan view illustrating a MEMS switch according to a second embodiment of the present invention.
Figure 19:
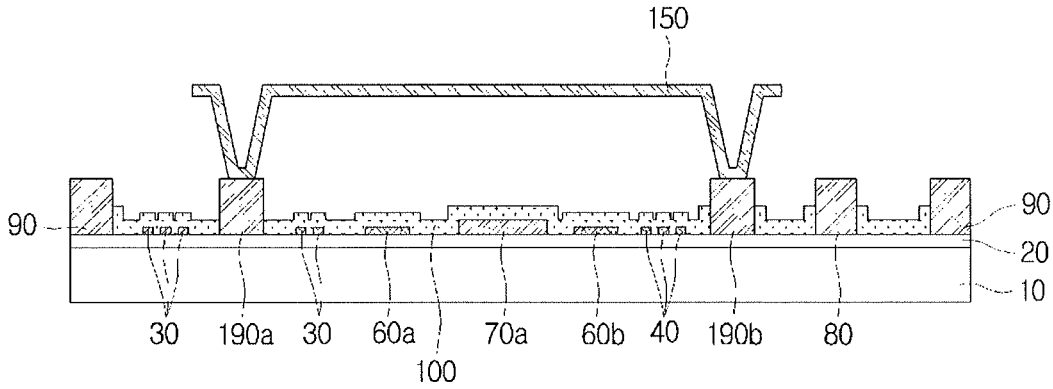
FIG. 19 is a sectional view illustrating the section cut along with II-IF line of the MEMS switch of FIG. 18.

FIG. 18 is a plan view illustrating an RF MEMS switch according to a second embodiment of the present invention. FIG. 19 is a sectional view illustrating the section cut along with II-IF line of the MEMS switch of FIG. 18. Here, FIG. 18 represents an embodiment of the branch-typed structure of a MEMS switch.

Referring to FIG. 18 and FIG. 19, an RF MEMS switch device according to a second embodiment of the present invention may include a substrate 10, a buffer layer 20, ground electrodes 190*a*, 190*b*, a bias electrode 80, a signal electrode 70, a dielectric layer 100, a membrane electrode 150, a bias line 30, pooling electrodes 60*a*, 60*b*, a pooling line 40 and an edge ground 90. Here, description of overlapped explanation compared to FIG. 1 and FIG. 2 will be omitted or made briefly.

The substrate 10 may be formed of a material suitable for semiconductor processing, such as high resistance silicon wafer, glass or GaAs, etc to keep RF characteristics.

The buffer layer 20 is formed on the substrate 10 and improves interfacial characterization.

The bias electrode 80 may be formed as an electrode to supply bias voltage on one side of the substrate 10.

The signal electrode 70 transmits an RF signal applied to one side end thereof to the other side end. The signal electrode 70 may be formed in the form of a long bar and both ends may be exposed to outside to be connected to external devices. Here, the signal electrode 70 may be formed to be overlapped with a predetermined region of the membrane electrode 150 by interposing the dielectric layer 100 therebetween. The signal electrode 70 may be formed with a metal material having high melting point and low resistance. The signal electrode 70 may be a metal pad formed with a metal pad formed of at least one metal material of Au, Cu, Al, Mo, W, Pt, Ru, Ni and the like or an alloy including any one of Au, Cu, Al, Mo, W, Pt, Ru, Ni and the like.

The ground electrode 190*a*, 190*b* may be formed to be spaced-apart from the bias electrode 80 and the signal electrode 70 on the buffer layer 20. Here, the ground electrode 190*a*, 190*b* may be formed to be extended along the length of the signal electrode 70. For example, the ground electrode 190*a*, 190*b* facing each other may be formed to be extended medially from each edge of the substrate 10. The ground electrode 190*a*, 190*b* may be formed of a metal material having high melting point and low resistance. The ground electrode 190*a*, 190*b* may be a metal pad formed with a metal pad formed of at least one metal material of Au, Cu, Al, Mo, W, Pt, Ru, Ni and the like or an alloy including any one of Au, Cu, Al, Mo, W, Pt, Ru, Ni and the like.

The ground electrode 190*a*, 190*b* inputs an RF signal to the membrane electrode 150 not to transmit the RF signal applied to one side of the signal electrode 70 to the other side before bias voltage is supplied.

The membrane electrode 150 is formed to be extended in one direction to be connected with the ground electrode 190*a*, 190*b* through the contact holes 120*a*, 120*b*. For example, the membrane electrode 150 extends in the cross direction to the longitudinal direction of the ground electrode 190*a*, 190*b*. The membrane electrode 150 is modified to be connected with the dielectric layer 100 when bias voltage is applied. The membrane electrode 150 is formed with a material having elasticity to allow moving up and down and restoring force when bias voltage is removed.

The dielectric layer 100 may be formed to cover the signal electrode 70, the bias line 30, the pooling electrode 60*a*, 60*b* and the pooling line 40 on the signal electrode 70. The dielectric layer 100 may be formed of a high dielectric material. The bias line 30 is connected with each side of the bias electrode 80 and the membrane electrode 150. For example, the bias line 30 may be formed in the form of a maximum length of the growing to have high resistance so that it can connect the bias electrode 80 with the spaced-farther-apart ground electrode 190*a*. The bias line 30 may be formed of a high resistance conductive material to prevent backflow of an RF signal to the bias electrode 80.

The pooling electrode 60*a*, 60*b* may be formed to be spaced-apart from the bias electrode 80, the signal electrode 70, the ground electrode 190*a*, 190*b* on the buffer layer 20. For example, the pooling electrode 60*a*, 60*b* may be formed between the signal electrode 70 and the ground electrode 190*a*, 190*b*. Further, the pooling electrode 60*a*, 60*b* is formed in a predetermined area and thus overlapped with the membrane electrode 150 by having dielectric layer 100 therebetween. The pooling electrode 60*a*, 60*b* may be formed of a metal material having high melting point and low resistance. The pooling line 40 is formed to connect one side of the signal electrode 70 with the pooling electrode 60*a*, 60*b*. For example, the pooling line 40 may be formed in the form of a maximum length of the growing to have high resistance between the signal electrode 70 and the ground electrode 190*a*, 190*b* so that it can connect the signal electrode 70 and the pooling electrode 60*a*, 60*b*. Further, the pooling line 40 may be formed of a high resistance metal material to prevent backflow of a RF signal applied to the signal electrode 70 to the pooling electrode 60*a*, 60*b*. An RF MEMS switch device according to a second embodiment of the present invention illustrated in RF MEMS switch device may be formed by a process which is similar to the process illustrated in FIG. 4 to FIG. 17. Here, it may be formed by the same process, except further forming ground electrodes and forming the bias line and the pooling line to be insulated from the ground electrode by having an insulating layer therebetween.

Figure 20:
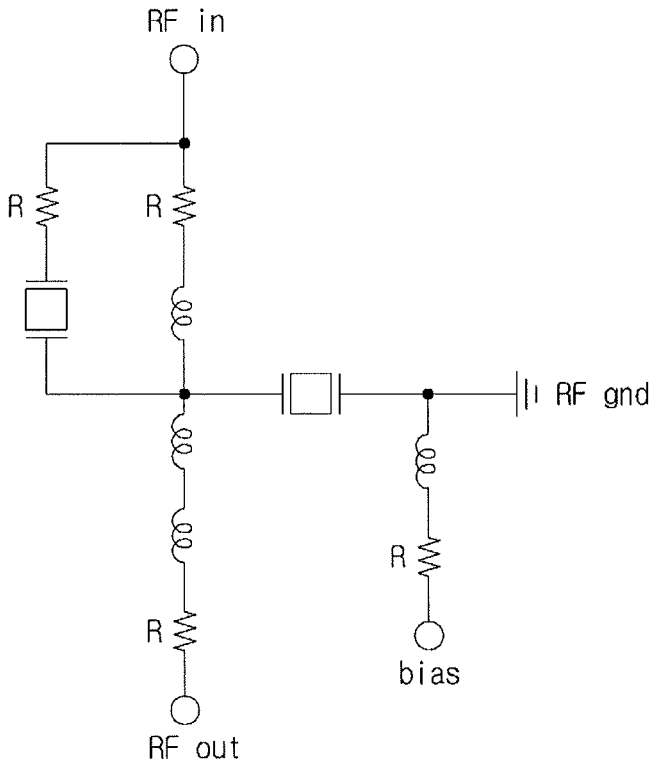

FIG. 20 is a circuit diagram illustrating an equivalent circuit of the MEMS switch of FIG. 18.

As shown in FIG. 20, an RF MEMS switch device according to a second embodiment of the present invention supplies bias voltage to the membrane electrode 150 and generates its corresponding electric potential difference between the signal electrode 70 and the membrane electrode 150 when bias voltage is supplied. In addition, electric potential difference between the membrane electrode 150 and the pooling electrode 60*a*, 60*b* is also generated. Thus, the membrane electrode 150 is bent to the direction of the dielectric layer 100 to contact to the dielectric layer 100 since attracting force is generated by the electric potential difference. When the membrane electrode 150 contacts with the dielectric layer 100, the RF signal applied to the signal electrode 70 is bypassed to the ground electrode 190*a*, 190*b* by coupling with the membrane electrode 150.

Later, when bias voltage is removed, the membrane electrode 150 returns to the original state so that an RF signal applied to one side end of the signal electrode 70 is transmitted to the other side end.

The pooling electrode 60*a*, 60*b* increases a pooling area functioning as a capacitor, resulting in increase of electrostatic force by the increased area even though the same driving voltage is applied. Therefore, when low driving voltage is applied, the membrane electrode 150 can be made to be bent.

Here, since the pooling line connected between the pooling electrode and the signal electrode is made of a high resistance metal material, RF signal coupling can be prevented by a capacitor formed between the pooling electrode and the signal electrode.

Because a MEMS switch device including pooling electrodes 60*a*, 60*b* according to a second embodiment of the present invention has higher capacitance value than that when the pooling electrode 60*a*, 60*b* is not formed, RF signal coupling can be prevented by a capacitor formed by introducing a high resistance pooling line while lowering driving voltage. Therefore, it allows improving on/off characteristics of the RF MEMS switch device.

While it has been described with reference to particular embodiments, it is to be appreciated that various changes and modifications may be made by those skilled in the art without departing from the spirit and scope of the embodiment herein, as defined by the appended claims and their equivalents.

DESCRIPTION OF REFERENCE NUMERALS

10: substrate
20: buffer layer
30: bias line
40: pooling line
50*a*, 50*b*: connecting electrode
60*a*, 60*b*: pooling electrode
70*a*, 70*b*: signal electrode
80: bias electrode
90: ground electrode
150: membrane electrode

What is claimed is:

1. An RF MEMS switch device comprising:
a substrate;
a bias electrode positioned on the substrate and supplying bias voltage;
a pair of signal electrodes positioned to be spaced-apart each other on the substrate and transmitting an RF signal from one side to the other side;
a dielectric layer formed on upper part of the pair of signal electrodes to be overlapped with the pair of signal electrodes;
a membrane electrode formed on the dielectric layer to be overlapped with the pair of signal electrodes and the dielectric layer;
a bias line positioned on the substrate, being formed of a first high resistance conductive material, and connecting the membrane electrode with the bias electrode;
at least one pooling electrode formed to be overlapped with the membrane electrode and having the dielectric layer be interposed therebetween; and
a pooling line positioned on the substrate, being formed of a second high resistance conductive material, and connecting any one of the pair of signal electrodes with the pooling electrodes;
wherein the pair of signal electrodes and the pooling electrode make the membrane electrode bend by using at least one of differences in electric potential between the pair of signal electrodes and the membrane electrode and between the pooling electrode and the membrane electrode.

2. The RF MEMS switch device of claim 1, wherein the pooling electrode is formed to be insulated from the signal electrode on the same plane with the signal electrode.

3. The RF MEMS switch device of claim 1, wherein the first or second high resistance conductive material comprises any one of SiCr, Ti, and TiW or a conductive material comprising any one of doped Si and SiC.

4. The RF MEMS switch device of claim 1, wherein the membrane electrode contacts with the dielectric layer to transmit an RF signal applied to one side of the signal electrodes to the other side of the signal electrodes, when the bias voltage is supplied.

5. The RF MEMS switch device of claim 1, further comprising at least one connecting electrode connected to the membrane electrode, wherein the connecting electrode is electrically connected with the bias line.

* * * * *